US008866103B2

(12) United States Patent
Cubric

(10) Patent No.: US 8,866,103 B2
(45) Date of Patent: Oct. 21, 2014

(54) CHARGED PARTICLE ENERGY ANALYSERS AND METHODS OF OPERATING CHARGED PARTICLE ENERGY ANALYSERS

(75) Inventor: Dane Cubric, Manchester (GB)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/808,169

(22) PCT Filed: Jun. 27, 2011

(86) PCT No.: PCT/EP2011/060711

§ 371 (c)(1),
(2), (4) Date: Jan. 3, 2013

(87) PCT Pub. No.: WO2012/007267

PCT Pub. Date: Jan. 19, 2012

(65) Prior Publication Data

US 2013/0105687 A1 May 2, 2013

(30) Foreign Application Priority Data

Jul. 13, 2010 (GB) ..... 1011716.6

(51) Int. Cl.
*G21K 5/04* (2006.01)
*H01J 49/48* (2006.01)

(52) U.S. Cl.
CPC ..... *H01J 49/48* (2013.01); *H01J 49/482* (2013.01)
USPC ..... 250/397; 250/396 R

(58) Field of Classification Search
CPC ..... H01J 37/026; H01J 37/04; H01J 37/10; H01J 37/12; H01J 37/147; H01J 37/1477; H01J 37/244; H01J 2237/004; H01J 2237/049; H01J 2237/10; H01J 2237/12; H01J 2237/121
USPC ..... 250/306, 396 R, 397
See application file for complete search history.

(56) References Cited

U.S. PATENT DOCUMENTS

| | | | | |
|---|---|---|---|---|
| 3,609,352 | A | 9/1971 | Harris | |
| 3,920,990 | A | 11/1975 | Van Nieuwland et al. | |
| 3,970,849 | A | 7/1976 | Brongersma et al. | |
| 6,762,408 | B1 | 7/2004 | Read | |
| 2008/0290287 | A1 * | 11/2008 | David | 250/396 R |

FOREIGN PATENT DOCUMENTS

WO WO 99/35668 7/1999

OTHER PUBLICATIONS

Read, "The parallel cylindrical mirror electron energy analyzer", Review of Scientific Instruments, 73(3), pp. 1129-1139.*

(Continued)

*Primary Examiner* — Nicole Ippolito
(74) *Attorney, Agent, or Firm* — Douglas E. Jackson; Stites & Harbison PLLC

(57) ABSTRACT

A charged particle energy analyzer (10) includes inner and outer cylindrically symmetric electrodes (11,12) arranged coaxially on a longitudinal axis (z-z) of the analyzer. A position-sensitive detector (17) has a particle-receiving detection surface located off-axis, at a radial spacing from the longitudinal axis (z-z) less than the radius of the inner electrode (11). Methods of operating the charged particle energy analyzer in first and second order focussing modes are described. A position-sensitive detector (17) suitable for use in "parallel analyzers" is described (FIGS. 7 and 8).

20 Claims, 5 Drawing Sheets

(56) References Cited

OTHER PUBLICATIONS

Ilyin A M et al: "New electrostatic energy analysers with a bounded cylindrical field; New electrostatic energy analysers with a bounded cylindrical field", Measurement Science and Technology, IOP, Bristol, GB, vol. 16, No. 9, (Sep. 1, 2005), pp. 1798-1801.
D. Roy and D. Tremblay: "Design of electron spectrometers", Rep Prog Phys, 53 (1990), pp. 1621-1674.
Jacka et al: "A fast, parallel acquisition, electron energy analyser: the hyperbolic field analyser", Rev Sci Inst, 70, No. 5 (1999), pp. 2282-2287.
Curtis et al: "Compact wide-aperture hyperbolic analysers", Rev Sci Inst, 59 (1988), pp. 2424-2428.
Ilyin: "New class of electrostatic energy analysers and a cylindrical face-field", Nucl Instr and Meth Phys Res A, 500 (2003), pp. 62-67.
International Search Report for PCT/EP2011/060711 dated Mar. 16, 2012.
Written Opinion of the International Searchting Authority for PCT/EP2011/060711 dated Mar. 16, 2012.
Invitation to Pay Additional Fees and , Where Applicable, Protest Fee dated Dec. 21, 2012.
GB Search Report for GB1011716.6 dated Nov. 15, 2010.
Read F H et al: "The parallel cylindrical mirror analyzer: axis-to-axis configuration", Nuclear Instruments & Methods in Physics Research. Section A: Accelerators, Spectrometers, Detectors, and Associated Equipment, Elsevier BV * North-Holland, Netherlands, vol. 519, No. 1-2, (Feb. 21, 2004), pp. 338-344.
D. Cubric et al: "Parallel acquisition electrostatic electron energy analyzers for high throughput nano-analysis", Nuclear Instruments and Methods in Physics Research Section A: Accelerators, Spectrometers, Detectors and Associated Equipment, vol. 645, No. 1, (Dec. 16, 2010), pp. 227-233.
Read Frank H: "The parallel cylindrical mirror electron energy analyzer", Review of Scientific Instruments, AIP, Melville, NY, US, vol. 73, No. 3, (Mar. 1, 2002), pp. 1129-1139.
Ilyin A M et al: "New electrostatic energy analysers with a bounded cylindrical field; New electrostatic energy analysers with a bounded cylindrical field", Measurement Science and Technology, IOP, Bristol, GB, vol. 16, No. 9, (Sep. 1, 2005), pp. 22-25.

* cited by examiner $$L=3.80\ E^{0.294} - 4.69 \quad [R1]$$

$$E=0.216\ L^{2.622} + 8.45 \quad [eV]$$

$$D=E\ (dL/dE) = 1.12\ E^{0.294}\ [R1]$$

CHARGED PARTICLE ENERGY ANALYSERS AND METHODS OF OPERATING CHARGED PARTICLE ENERGY ANALYSERS

This invention relates to analytical instrumentation, particularly charged particle energy analysers being able to record a wide energy range simultaneously.

Charged particle energy analysers find widespread application in academic research and in industry, and can be used to determine the atomic composition and properties of solids and gases. Specifically, charged particle energy analysers can be used in the characterisation and quantitative analysis of the surfaces of solids; for example, in the semiconductor technology industry they can be used to assess the elemental composition of surface features before, during and after different processes are carried out during the fabrication of a semiconductor device. In use, a sample placed in a vacuum is exposed to x-rays, electrons or ions and, in response to such irradiation, emits photons, photoelectrons, secondary electrons, Auger electrons, elastically scattered electrons or ions. The charged particles emitted from the sample surface in this way are detected as a function of kinetic energy and recorded as energy spectra which characterise the sample material.

Various charged particle energy analysers are available and have been described in numerous papers; concentric hemispherical analysers and cylindrical mirror analysers being most often used. The main types of electrostatic analysers are reviewed in a paper by D. Roy and D. Tremblay, Rep. Prog. Phys. 53 (1990) 1621-1674. The range of energies (i.e. energy window) that those analysers obtain at any one time is limited typically to a ratio ER between maximum and minimum energies of less than 1.1.

It is often required, as in Auger electron spectroscopy of surfaces, to acquire an energy spectrum in a much wider energy range, for example ER≈20 or more. Spectra with such a wide energy range can be obtained using standard analysers by varying voltage supplied to the analyser elements so as to scan the detected energies across the detector to cover the desired energy range.

However, this process is laborious and time consuming, and is too slow when multiple spectra need to be obtained quickly at different positions on the sample surface. The problem has become particularly acute with the advent of nano technology. Analysis of semiconductor devices fabricated using nano technological processes (nano-analysis) requires high spatial resolution and so demands a high throughput analysis. For such applications it is desirable to analyse the entire energy spectrum simultaneously.

A hyperbolic field analyser of the kind described by M. Jacka et al in Rev. Sci. Instrum. 70 (1999) 2282-2287 is able to do this. As shown in FIG. 1 the hyperbolic field analyser has a planar geometry and is an example of a so-called "parallel" analyser; that is, an analyser whereby charged particles having different kinetic energies are simultaneously focussed at different longitudinal positions. FIG. 1(*a*) is illustration of two planes normal to each other, ZY and ZX in a XYZ coordinate system. FIG. 1(*b*) illustrates a simplified cross-sectional view through the hyperbolic analyser in the ZY plane with, by way of example, two bunches of electron trajectories, having different energies, E1 and E2, where E2>E1, being focusing at two longitudinal positions, Z1 and Z2 respectively. The electrons reach a hyperbolic electrostatic field region, 30, starting from a field free region 31. The hyperbolic electrostatic field region 30, is created between electrically conductive horizontal and vertical plates, 32, typically held at ground voltage and a hyperbolically shaped electrode, 33, held at negative voltage with respect to electrodes 32 when electrons are detected or at positive voltage with respect to electrodes 32 when positive ions are to be detected. The hyperbolic electrostatic field within the analyser provides square root dependency of focusing position Z on energy E, and so a very wide energy range can simultaneously be detected along a position sensitive detector placed longitudinally along the Z axis. FIG. 1(*c*), on the other hand, illustrates the same foci in the transverse ZX plane and shows that electrons are brought to a focus along transversely-extending, slightly curved, lines of non-uniform length, where the length of the lines increases as a function of increasing kinetic energy. The length of each line also depends on the width of the entrance aperture, in the ZX plane, the wider the aperture the greater the length of the line. This arrangement is inconvenient because a very wide detector would be needed to capture the higher energy electrons.

Alternatively, if a narrower detector is used, a high proportion of the electrons under analysis would be lost from detection. Furthermore, for many applications, a relatively wide entrance aperture is desirable so as to increase the particle flux and so to improve the sensitivity of the analyser; however, with this planar geometry the size of the aperture is constrained by the width of the detector and decreasing overall focusing quality for wide apertures.

U.S. Pat. No. 6,762,408 describes a parallel analyser having cylindrical geometry. This analyser comprises inner and outer cylindrical electrodes coaxially arranged on a longitudinal axis. Electrostatic voltage is supplied to the inner and outer cylindrical electrodes to create an electrostatic focussing field between the electrodes, with the voltage supplied to the outer electrode varying substantially linearly as a function of axial distance along the electrode.

As with the hyperbolic analyser, charged particles are focussed at different axial positions according to energy. Additionally, the analyser focuses charged particles in a plane normal to the axis due to its axial symmetry. In one described embodiment, charged particles are focussed at the longitudinal axis of the analyser. However, this arrangement has the drawback that the focussed particles are confined to a very narrow detection zone, and this can reduce the working life of the detector. In another embodiment charged particles are focussed at the inner cylindrical electrode; however, this arrangement requires a curved detector which is difficult and costly to implement in practice. In yet another embodiment charged particles are focussed at a transverse plane, orthogonal to the longitudinal axis. However, this arrangement requires a large, two-dimensional, disc-like, position-sensitive detector which, again, is difficult and costly to implement in practice, and which also increases the transverse dimensions of the analyser where space can be at a premium. In the first two embodiments, charged particles are introduced into the electrostatic focussing field via an entrance aperture in the inner cylindrical electrode, resulting in a short working distance WD (close to radius of the inner cylinder, R1) relative to the front end of the analyser which, again, is inconvenient in practice. The third embodiment requires large angles with respect to the axis in order to focus to the transverse plane hence again making working distance small (close to R1).

It is an object of the invention to provide a charged particle energy analyser of predominantly cylindrical symmetry that at least alleviates at least some of the afore-mentioned problems.

According to the invention there is provided a charged particle energy analyser for simultaneous detection of charged particles, the analyser comprising inner and outer cylindrically symmetric electrodes arranged coaxially on a longitudinal axis, the inner cylindrically symmetric electrode having a circumference of radius R1, biasing means for supplying voltage to the inner and outer cylindrically symmetric electrodes to create an electrostatic focussing field between the electrodes, a charged particle source for introducing charged particles into the electrostatic focussing field for analysis, and a detector for detecting charged particles focussed by the electrostatic focussing field, wherein the detector has a charged particle-receiving detection surface located off-axis, at a radial spacing from the longitudinal axis less than said radius R1.

It will be understood that the term "cylindrically symmetric electrode" is intended to embrace non-cylindrical electrodes that have cylindrical symmetry as well as cylindrical electrodes, and also incomplete electrodes; that is, electrodes that subtend angles less than 2π at the longitudinal axis.

In one preferred embodiment, said inner cylindrically symmetric electrode has a truncated configuration and said charged particle-receiving surface of the detector is located in a truncation plane of the inner electrode. The inner cylindrically symmetric electrode may include electrically conductive wires spanning a missing segment of the inner electrode. In yet another preferred embodiment, a segment of the inner cylindrical electrode is missing defining a gap between the exposed longitudinally-extending edges of the electrode, and said detector is mounted in said gap.

In preferred embodiments of the invention, the inner and outer cylindrically symmetric electrodes have an end plate provided with an entrance aperture at a radial distance from the longitudinal axis larger than R1 and said charged particle source is arranged to introduce charged particles into the electrostatic focussing field for analysis via the entrance aperture in the end plate. The charged particle source may include means for mounting a sample on the longitudinal axis outside the inner and outer cylindrical electrodes. By providing an entrance aperture in the end plate at radial distance larger than R1, the analyser has a much greater working distance than is possible with the known arrangements described hereinbefore.

Embodiments of the invention are now described, by way of example, with reference to the accompanying drawings, of which:

FIG. 1(*b*) illustrates a simplified cross-sectional view through a hyperbolic analyser in the ZY plane showing two bunches of electron trajectories having different energies, E1 and E2, where E2>E1, being focused at two longitudinal positions, Z1 and Z2 respectively.

FIG. 1(*c*) illustrates the same foci as in FIG. 1(*b*) in the transverse ZX plane and shows that electrons are brought to a focus along transversely-extending, slightly curved lines of non-uniform length, where the length of the lines increases as a function of increasing kinetic energy.

Figure 2:
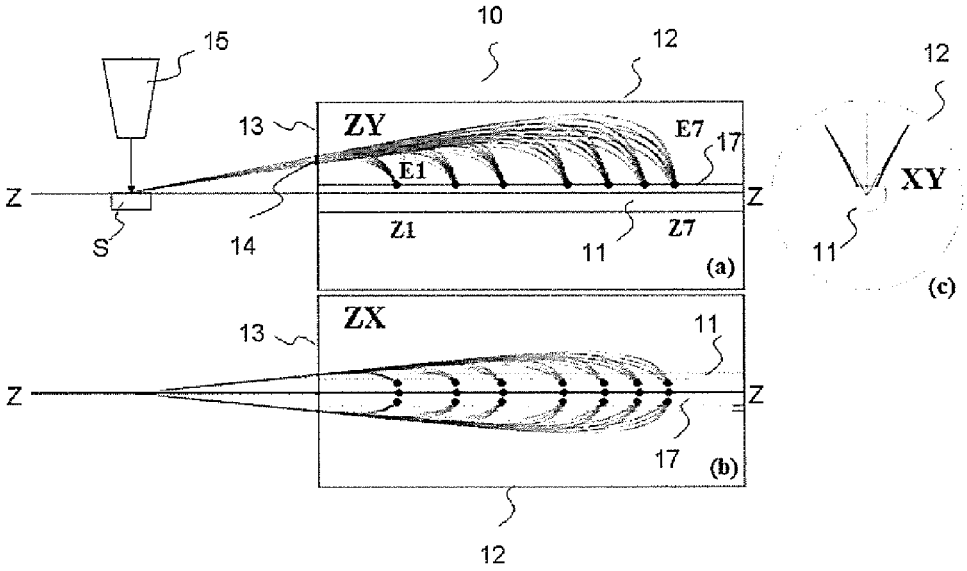
FIG. 2(*a*) is a schematic cross-sectional view, in the ZY plane, through an analyser according to the invention with a working distance WD=10R1, where R1 is the radius of the inner cylindrical electrode and the radius of the outer cylinder is R2=5R1. In this illustration, seven bunches of charged particle trajectories are shown, covering an energy ratio of ER=E7/E1=25.

FIG. 2(*b*) is a schematic, cross-sectional view, in the ZX plane, through the analyser shown in FIG. 2(*a*). In this illustration, at each energy E1, E2 . . . E7, charged particle trajectories at three azimuthal angles −30°, 0°, 30° are focussed on respective transversely-extending lines of uniform width in the transverse direction.

FIG. 2(*c*) is a schematic, cross-sectional view, in the XY plane, of the analyser shown in FIGS. 2(*a*) and 2(*b*) and illustrates the truncated configuration of the inner cylindrical electrode.

Figure 3:
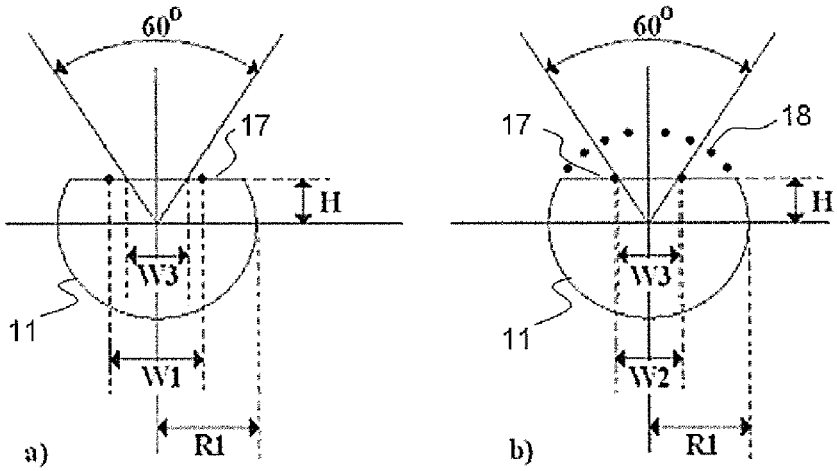

FIG. 3(*a*) is a schematic, cross-sectional view through the inner cylindrical electrode with the particle-receiving surface of the detector being located off-axis at a radial spacing H.

FIG. 3(*b*) is a schematic, cross-sectional view through the inner cylindrical electrode provided with electrically conductive wires spanning a missing segment of the truncated electrode in the longitudinal direction.

Figure 4:
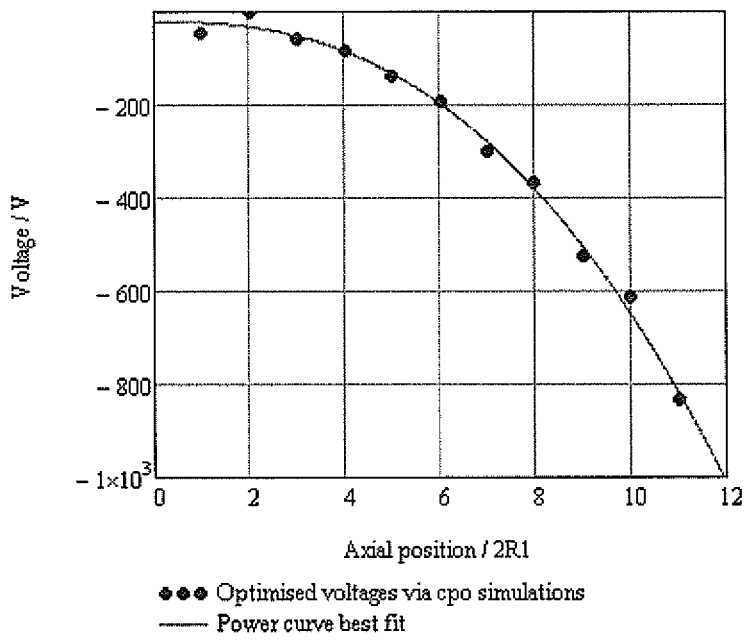

FIG. 4 is a plot showing voltage applied to the outer cylindrical electrode as a function of distance in the longitudinal direction, measured in units of 2R1 measured from the transverse front plate of the analyser. In practice, the outer cylindrical electrode comprises a set of rings and voltages are supplied to the rings according to their axial position to mimic the voltages shown in the plot. Points represent voltages obtained after charged particle optimisation and the full curve is the best fit curve following a power curve shape of the form V(n)=A*(nˆB+C). A=−1.994, B=2.498 and C=10.45 in this example and n=z/2R1.

Figure 5:
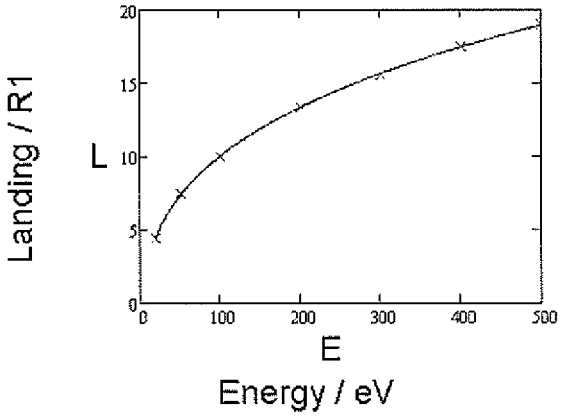

FIG. 5 illustrates how focusing position (landing position, L) in the analyser shown in FIG. 2 depends on energy, E in units of eV.

Figure 6:
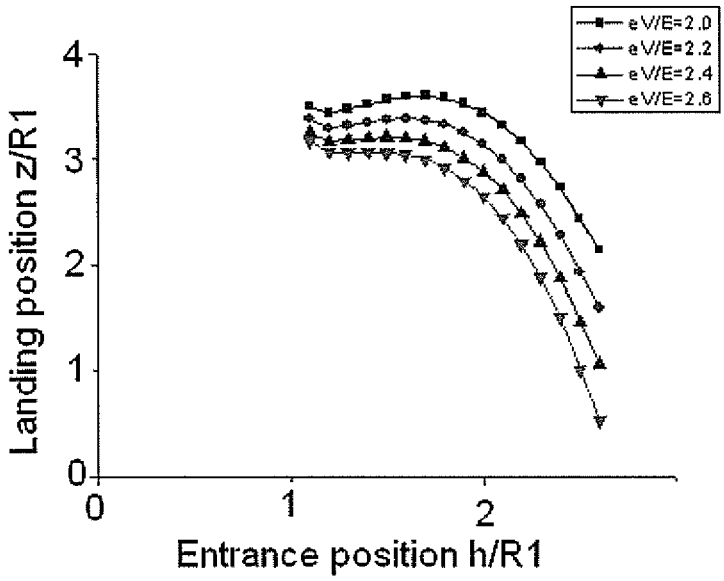

FIG. 6 illustrates second order focussing achieved by supplying the same voltage to all the segmented rings of the outer cylindrical electrode. The Figure illustrates how landing position varies as a function of beam entrance position, h, for several voltages applied to the outer cylinder, where WD=10R1 and H=0.5R1, as in the analyser of FIG. 2 and where the inner cylindrical electrode is provided with electrically conductive wires, as shown in FIG. 3(*b*).

Figure 7:
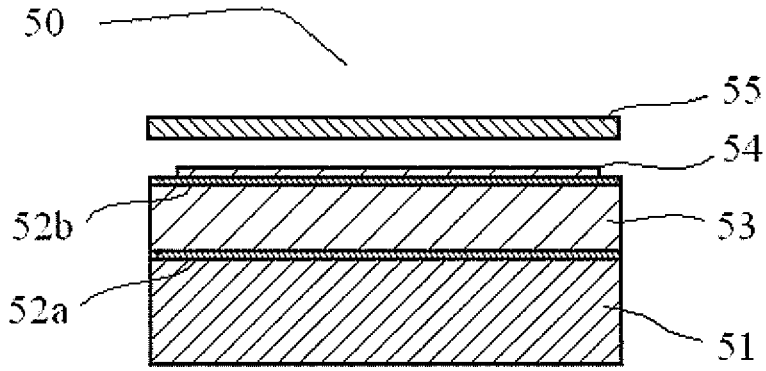

FIG. 7 shows a simplified cross-section drawing of the charged particle detector 50.

Figure 8:
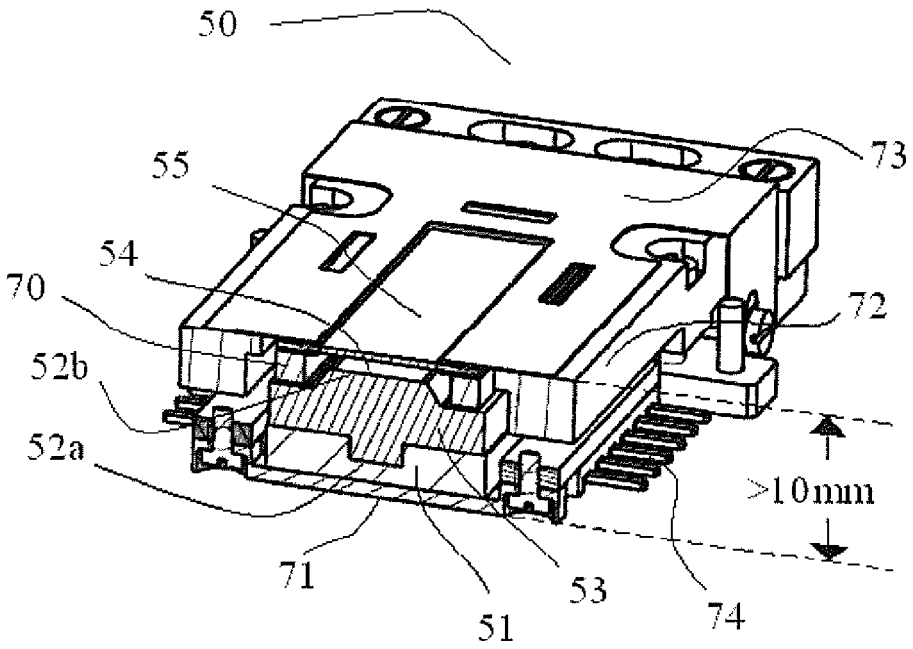

FIG. 8 shows a cross-section 3D drawing of a practical position sensitive charge particle detector embodiment suitable for some parallel analyser configurations.

Referring now to FIGS. 2(*a*), 2(*b*) and 2(*c*) of the drawings, the charged particle energy analyser 10 includes inner and outer cylindrical electrodes, 11, 12 arranged coaxially on a longitudinal axis (Z-Z) of the analyser.

A voltage source is arranged to supply voltage to the electrodes to create an electrostatic focussing field between the electrodes. In the case of analysis of electrons, the outer electrode 12 is maintained, in use, at a negative voltage relative to the inner electrode 11 that is typically, though not necessarily, maintained at ground potential. In the case of analysis of positively charged particles, the outer electrode 12 is maintained, in use, at a positive voltage relative to the inner electrode 11.

As will be explained, the electrostatic focussing field has a substantially non-linear potential distribution in the axial direction. In this embodiment, the outer electrode 12 comprises an assembly of n mutually insulated, electrically conductive rings (not shown on the diagram) arranged in a stack extending in the axial direction, with a respective voltage $V_1$, $V_2$ . . . $V_n$ applied to each ring in the stack to create the required potential distribution.

FIG. 4 shows, by way of example, a plot of applied voltage V(z) against ring number n, for rings of width 2R1, corresponding to axial distance z. Points represent voltages obtained via charged particle optical simulations while the full curve represents the least square fit of the function of the shape:

$$V(z)=A\cdot(z^B+C)$$

where z is axial position measured from the front face of the analyser in units of R1, A is a proportionality constant in volts that determines absolute values of the voltages and B and C are dimensionless parameters. For example, referring to FIG. 2, if E1=20 eV and E7=500 eV, then A=−1.99V, B=2.50 and C=10.45 for this particular example.

Referring again to FIGS. 2(*a*), 2(*b*) and 2(*c*), the inner and outer cylindrical electrodes 11, 12 have an end plate 13 formed with an arcuate entrance aperture 14.

A sample S is positioned on longitudinal axis (Z-Z) outside the cylindrical electrodes and is irradiated with primary electrons generated by a primary electron source 15 (depicted in FIG. 2(*a*)). Secondary electrons emitted from the sample are introduced into the electrostatic focussing field for analysis via the entrance aperture 14 in the end plate 13. In this embodiment, the sample S is irradiated with electrons. However, it will be appreciated that alternative forms of irradiation means could be used; for example, the sample could be irradiated with positively or negatively charged ions, x-rays, laser light or UV light to generate positively or negatively charged particles, for analysis as required.

FIGS. 2(*a*), (*b*) and (*c*) also depict projections of bunches of electron trajectories onto respective planes, characterised by seven energies, E1 to E7, with an energy ratio ER=E7/E1=25 in this example, which are focussed at respective positions Z1 to Z7 in the axial direction, the dependency of which is shown in FIG. 5.

As shown in FIG. 2(*a*), the inner cylindrical electrode 11 has a truncated configuration; that is, a segment of the electrode is missing. This configuration allows a position-sensitive detector 17 to be mounted inside the electrode 11.

The position sensitive detector 17 has a flat, particle-receiving detection surface which, in this embodiment, is positioned in a mid-plane, half way between the circumference of the inner cylindrical electrode 11 and the longitudinal axis (Z-Z); that is, at a radial separation of 0.5R1 from the longitudinal axis, where R1 is the radius of the inner cylindrical electrode. The electrostatic focussing field created between the inner and outer cylindrical electrodes is tailored to focus charged particles at this surface. Thus, the particle-receiving surface of the detector is positioned inside the inner cylindrical electrode, and although a mid-plane configuration is depicted in this embodiment, radial separations in the range 0.1R1 to 0.8R1 are also found to be particularly useful As shown in the longitudinal sectional ZY view of FIG. 2(*b*), electrons are focussed at the particle receiving surface of the detector at different respective axial positions Z1, Z2 . . . Z7, in the direction of the longitudinal axis, as a function of energy E1, E2 . . . E7.

However, as shown in the transverse ZX sectional view of FIG. 2(*b*), at each axial position, electrons emanating at the three illustrative azimuth angles, −30°, 0° and +30°, are focussed along a respective line extending in a transverse direction, orthogonal to the longitudinal axis Z-Z. These lines of focus practically all have the same width in the transverse direction which is practically independent of the electron energy E. Therefore, the electrons do not diverge in ZX plane as in case of hyperbolic analyser (FIG. 1(*c*)), nor are they confined to a narrow, line like, detection zone at the particle-receiving surface of the detector 17, but are distributed across the particle-receiving surface resulting in prolonged working life of the detector 17. Near cylindrical symmetry of the analyser allows larger entrance apertures, and so higher particle fluxes to be used FIGS. 3(*a*) and 3(*b*) show schematic cross-sectional views through two embodiments of the inner cylindrical electrode 11 of the analyser 10. The inner cylindrical electrode, shown in FIG. 3(*a*), corresponds to that shown in FIG. 2, albeit on an enlarged scale. FIG. 3(*b*), on the other hand, shows an inner cylinder electrode where the missing part of the truncated electrode is replaced with thin electrically conductive wires, preferably 50 micron diameter or less, extending in the longitudinal direction. The angular spacing between the wires in this example is 15°. H shows position of the truncated plane of the inner cylindrical electrode with respect to the axis of the system. The angle of 60° shown in FIGS. 3(*a*) and 3(*b*) represents the angular range of electron trajectories corresponding to a full 60° azimuth angle at the entrance aperture 14 of the analyser. W1 (FIG. 3(*a*)) indicates the transverse width of the focusing positions of such electron trajectories in the case of a truncated inner cylindrical electrode. W3 (FIGS. 3(*a*) and 3(*b*)), on the other hand, shows the transverse width in an ideal case for which the inner cylindrical electrode is not truncated, whereas W2 (FIG. 3(*b*)) shows the transverse width for the depicted configuration of a truncated electrode in combination with longitudinally-extending electrically conductive wires. W1 is practically equal to R1 irrespective of the height H, whereas in configuration depicted in FIG. 3(*b*), W2 is almost the same as W3 and is related to height H as W2≈1.25H. Thus, the use of electrically conductive wires is advantageous because it enables the transverse focussing width to be chosen so as to match the width of the detector by appropriately selecting the height H.

As shown in the embodiments of FIGS. 3(*a*) and 3(*b*), the detector 17 is positioned within the circumference, of radius R1, of the inner cylindrical electrode 11 where it's flat, charged particle-receiving surface is positioned off-axis at a distance H preferably in the range H=0.1R1 to 0.8R1; for example, at a distance H=0.5R1, as shown in FIG. 2.

In the embodiment shown in FIG. 2, the entrance aperture is provided in the end plate at a middle-of-aperture radial distance h=1.95R1 from the longitudinal axis and the sample S is mounted on the longitudinal axis outside the inner and outer cylindrical electrodes 11, 12, resulting in a greater working distance WD (10R1) than can be achieved with known arrangements. Aperture radial distances in the range from h=1.1R1 to 2.5R1 are also found useful when configurations with other working distances WD from 3R1 to 14R1 respectively are used.

In the embodiments described with reference to FIGS. 2 and 3, the inner and outer cylindrical electrodes 11, 12 subtend the angle 2π around the longitudinal axis Z-Z. However, in alternative embodiments of the invention, the electrodes may subtend an angle of less than 2π around the longitudinal axis; for example, an angle in the range π/3 to π/2.

The charged particle energy analysers described with reference to FIGS. 2 and 3 are effective to focus charged particles simultaneously in a wide energy window, in the longitudinal direction, at particle-receiving surface of a position sensitive detector placed off-axis. This mode of operation could be appropriately called 'parallel mode'. Focusing in this mode is predominantly of the first order, meaning that the longitudinal spread of charged particles at the focus point is proportional to the square of the charged particles entrance angular spread, Δα, that is in turn determined by the entrance aperture width. Relative energy resolution ΔE/E is in that case also proportional to the square of the angular spread. Practically, the aperture width is adjusted to provide average energy resolution of about ΔE/E=0.5% for all energies within the wide energy window.

However it is sometimes useful to examine a smaller portion of the full energy window within the spectrum with higher energy resolution. In that case, it is proposed to operate the analyser in a second order focusing mode, where the longitudinal spread of the charged particles at the focus is proportional to the cube of the $\Delta\alpha$. At the same time, the working distance should remain the same as that set for parallel mode of operation. The second mode of focusing could provide better relative energy resolution in the narrow energy window region, typically $\Delta E/E=0.2\%$ or better. A second order focus occurs at a fixed longitudinal position at the particle-receiving surface of the detector; that is, the longitudinal position of the focus does not shift along the particle-receiving surface of the detector as a function of voltage supplied to the outer cylindrical electrode. However, voltage supplied to the outer electrode in the second order focussing mode is related to the energy of charged particles brought to a focus at the fixed longitudinal position. Consequently, it is possible to scan the supplied voltage sequentially and record the resultant energy spectra in the vicinity of the second order focus.

With given 'parallel mode' voltages supplied to the outer cylindrical electrode the second order focusing could occur at the point close to the front end of the detector. This corresponds to the low energy end of the energy window. To obtain the full spectrum in high energy resolution one would need to scan the voltages across the outer cylinder segments and record spectra for different energies in the vicinity of the second order focusing position. However this direct method of scanning the voltages, set originally for 'parallel mode' is not practical. This is because ratio between the maximum voltage applied to the far segment of the analyser in parallel mode and the energy at the region of the second order focusing is too high, typically of the order of 40.

Preferably, when second order focusing is to be exploited for high resolution it is desirable to supply the same voltage to all segments of the outer cylindrical electrode. This could, in turn, provide energy/voltage ratio between 1 and 3, which is suitable for scanning. FIG. 6 shows an example of second order focusing where the landing positions are depicted as a function of the entrance position, hence entrance angle. In this particular example, WD=10R1 and detector off-axis position, H=0.5R1. Four curves are shown for voltage/energy ratios from 2 to 2.6.

Operation of the analyser in the second order focussing mode therefore involves supplying a single voltage to all the segments of the outer cylindrical electrode, scanning the supplied voltage, and recording the spectra in the vicinity of the second order focus at the detector. This differs significantly from an earlier proposed method, such as that disclosed in U.S. Pat. No. 6,762,408, where voltages supplied for parallel mode focussing are directly scanned.

Detectors suitable for the "parallel analysers" i.e. analysers as described in the text and embodiments, include various charged particle, position sensitive detectors including delay line detectors, resistive anode detectors and detectors based on semiconductor technology. Particularly suitable are detectors that have a small overall depth in a direction normal to the detection surface of the detector. This direction often crosses the plane in which the sample is placed. If the sample is a large diameter wafer, a detector that protrudes out of the analyser body too far could come into contact with the wafer surface.

Particularly suitable charged particle detectors having a small overall depth (for example, 10 mm or less) can be assembled using a semiconductor detector of the NMOS, CMOS or CCD type as a component. These semiconductor detectors are typically position sensitive and are predominantly used for detection of photons. By coupling such a detector to a fiber optic plate (FOP) covered in phosphor and to a micro-channel plate (MCP), and applying high voltage of several kV between the MCP and the phosphor, the detector becomes sensitive to charged particles that are incident on the MCP. This is due to amplification by the MCP, of the incident charged particle flux and then conversion, by the phosphor, of the amplified charged particle flux, exiting the MCP and incident on the phosphor, into photon flux that the semiconductor detector can detect. High voltage at the phosphor surface, however, can cause the semiconductor detector to malfunction due to exposure of the sensitive semiconductor elements of the detector to the electric field between the phosphor layer and the semiconductor elements that are typically kept close to the ground voltage.

FIG. 7 is a simplified sectional view of a charged particle detector 50 having a preferred configuration in which a semiconductor detector 51 is coupled to a single FOP 53 and a MCP 55. A surface of the FOP 53 adjacent to the detector 51 is covered with a first optically transparent conductive layer 52*a*. This layer is preferably of Indium Tin Oxide (ITO) and has to be grounded or kept at the average voltage of the sensitive semiconductor detector elements. The opposite surface of the FOP 53, adjacent to the MCP 55, is covered with a second optically transparent conductive layer 52*b* (preferably ITO or a very thin aluminum layer). This second layer 52*b* is electrically insulated from the first layer 52*a* by the bulk of the FOP 53. A phosphor layer 54 is placed on top of the second conductive layer 52*b* and a high voltage is supplied to the second conductive layer 52*b*. This voltage is several kilovolts (typically 4 kV) with respect to the voltage on the first conductive layer 52*a*. The MCP 55 is positioned a small distance away from the phosphor (typically 1 mm distance). A voltage of typically 1 kV is applied across the MCP 55 with a voltage difference, typically 3 kV, between the second conductive layer 52*b* and the side of the MCP 55 adjacent to the second conductive layer 52*b*. When the charged particle detector 50 is mounted in the parallel analyser, the MCP top surface is aligned with the focusing plane of the analyser (17 in FIGS. 2 and 32 in FIG. 1 for example). In this arrangement the sensitive semiconductor detector elements within the detector body 51 are electrically screened from the voltage at the second conductive layer 52*b*. Therefore, high voltage can be applied to the second conductive layer 52*b* without influencing the detector. The screening is achieved by the said first conductive layer 52*a* which is readily connected to the ground voltage or average voltage of the semiconductor detector elements. Moreover, the overall thickness of the FOP 53 can be made small (for example 3 to 5 mm) making an entire detector very compact.

This detector configuration is particularly suitable for use in a parallel analyser described in this text as it enables the analyser and detector combination to have a small mechanical footprint in a direction normal to the detection surface of the detector.

Figure 1:
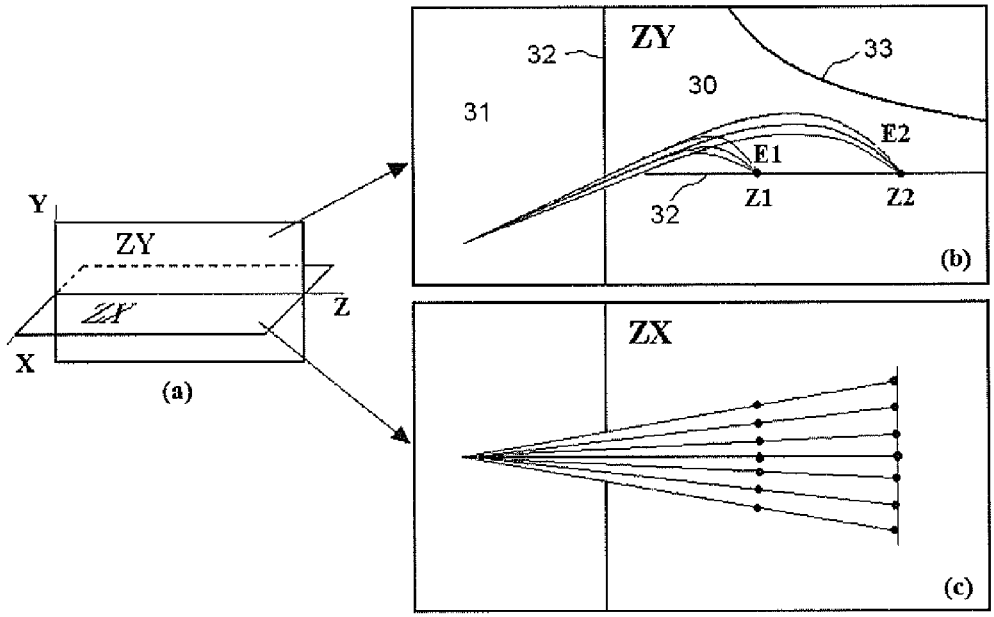
FIG. 1(*a*) illustrates two planes normal to each other, ZY and ZX in the XYZ coordinate system.

As this detector configuration is particularly well suited for the parallel analysers that are described in this text with reference to FIGS. 1 and 2 as examples, we therefore consider it important to claim a charged particle energy analyser for simultaneous detection of charged particles within a range of energies, the analyser comprising position sensitive detector which has a single optically transparent electrically non-conductive plate (preferably FOP) on top of the semiconductor detector where the two opposing sides of the said optically transparent plate are covered in optically transparent electro-conductive material (preferably ITO) and the potential of the said optically conductive material adjacent to the semiconductor detector is kept close to the detector common potential while the voltage of the other layer of optically conductive material is adjusted to a voltage of several kilovolts (typically 3 kV) with respect to the voltage of an adjacent MCP surface.

FIG. 8 shows a cross-sectional 3D schematic of a preferred practical embodiment of the charged particle detector according to the principles that were described in relation to FIG. 7. In addition to elements 51 to 55 as described with reference to FIG. 7 this practical embodiment also contains stand-off ceramic supports 70 that separate the FOP 53 and the MCP 55. A metal base 71 together with a ceramic frame 72 and a thin metal plate 73 hold all the detector components together in a "sandwich" type structure. The detector electrical contacts 74 are aligned horizontally. The overall depth of this position sensitive charged particle detector embodiment in the direction normal to the exposed MCP detection surface is less than 10 mm, as indicated in FIG. 8.

The analysers described in this text can be applied for fast Auger electron spectra acquisition where the sample region under investigation is sputtered with ions in order to remove the first few atomic layers of contamination (typically carbon layers). During sputtering high fluxes of charged particles can be released that, in turn, can damage the position sensitive detector within the analyser. It is preferred to have a charged particle shutter mounted in front of the aperture, in between the aperture and the source of charged particles at the sample. It is most preferable, though not necessary, to operate the shutter by electrical means only, by applying a voltage at shutter elements that disperse the charged particles and hence significantly decrease the charged particle flux entering the analyser. An analyser having a mechanical shutter operated by electrical means is also feasible to implement.

It can be advantageous to place more than one analyser, of the type described in the text and illustrated by described embodiments, around the sample so to arrange the analysers to have overlapping fields of view of the sample. Two, three or four analysers are preferable to arrange in such a configuration. One advantage of such multiple analyser configuration is a further increase of the total detection efficiency of the elemental analysis via observation of the electron energy spectra emanating from the sample. More importantly, such configuration also enables topography analysis of the sample via simultaneously recording the spectra from geometrically different points of view due to different analyser positions around the sample. An instrument configuration with two to four analysers therefore enables simultaneous elemental and topography analysis.

The invention claimed is:

1. A charged particle energy analyser for simultaneous detection of charged particles within a range of energies, the analyser comprising:

inner and outer cylindrically symmetric electrodes arranged coaxially on a longitudinal axis, the inner cylindrically symmetric electrode having a circumference of radius R1, biasing means for supplying voltage to the inner and outer cylindrically symmetric electrodes to create an electrostatic focussing field between the electrodes, a charged particle source for introducing charged particles into the electrostatic focussing field for analysis, and a detector for detecting charged particles focussed by the electrostatic focussing field, wherein the detector has a flat, charged particle-receiving detection surface parallel to the longitudinal axis and located off-axis, at a radial spacing from the longitudinal axis less than said radius R1.

2. An analyser as claimed in claim 1 wherein said inner cylindrically symmetric electrode has a truncated configuration and said charged particle-receiving surface of the detector is located at a truncation plane of the inner electrode.

3. An analyser as claimed in claim 2 wherein said inner cylindrically symmetric electrode includes electrically conductive wires spanning a missing segment of the inner electrode.

4. An analyser as claimed in claim 1 wherein a segment of the inner cylindrically symmetric electrode is missing defining a gap between exposed, longitudinally-extending edges of the electrode, and said detector is mounted in said gap.

5. An analyser as claimed in claim 1 wherein said radial spacing from the longitudinal axis is in the range from 0.1R1 to 0.8R1.

6. An analyser as claimed in claim 1 wherein said electrostatic focussing field has a potential distribution that varies non-linearly in the direction of the longitudinal axis whereby to focus charged particles at said detection surface at different axial positions, in the direction of the longitudinal axis, as a function of energy.

7. An analyser as claimed in claim 6 wherein said outer cylindrically symmetric electrode is a cylindrical electrode and voltage V(z) supplied by said biasing means to the cylindrical electrode varies substantially according to a power function of the form:

$$V(z)=A\cdot(z^B+C)$$

where z is distance along the electrode in the direction of the longitudinal axis and A, B and C are constants.

8. An analyser as claimed in claim 1 wherein the inner and outer cylindrically symmetric electrodes have an end plate provided with an entrance aperture, and said charged particle source is arranged to introduce charged particles into the electrostatic focussing field for analysis via the entrance aperture in the end plate.

9. An analyser as claimed in claim 8 wherein the charged particle source includes means for mounting a sample on the longitudinal axis outside the inner and outer cylindrical electrodes.

10. An analyser as claimed in claim 8 wherein a charged particle shutter is placed between the said entrance aperture and the source of the charged particles.

11. An analyser as claimed in claim 1 wherein the inner and outer cylindrically symmetric electrodes have an end plate provided with an entrance aperture, and said charged particle source is arranged to introduce charged particles into the electrostatic focussing field for analysis via the entrance aperture in the end plate positioned at radial distance from the longitudinal axis in the range from 1.1R1 to 2.5R1.

12. An analyser as claimed in claim 1 wherein the detector is a position sensitive detector.

13. An analyser as claimed in claim 1 where the charged particle detector contains a semiconductor detector member coupled to a single fiber optic plate (FOP) and micro channel plate (MCP), where the said FOP opposing sides are covered with conductive optically transparent layers, and the layer adjacent to the semiconductor detector sensitive elements is kept at ground voltage or a voltage close to average voltage of the said semiconductor detector sensitive elements while the second layer, adjacent to said MCP, is covered in phosphor and kept at a high positive voltage of several kV with respect to the said MCP.

14. An analyser as claimed in claim 1 where the inner and outer cylindrically symmetric electrodes subtend an angle of less than $2\pi$ at the longitudinal axis.

15. An analyser assembly containing two, three or four analysers as claimed in claim 1 where all analysers within said combination are arranged so to have overlapping fields of view of the sample.

16. A method of operating the charged particle energy analyser as claimed in claim 1 wherein voltage supplied to said outer electrode provides a substantially constant potential distribution in the direction of the longitudinal axis so that second order focusing of charged particles is achieved across a selected narrower energy range.

17. A method of operating the charged particle energy analyser as claimed in claim 16 wherein said voltage supplied to said outer electrode is scanned and spectra recorded in the detector region of the second order focusing.

18. A method of operating the charged particle energy analyser as claimed in claim 16 including switching voltage supplied to said outer electrode between two different, non-scalable sets of voltages, a voltage creating a potential distribution that varies non-linearly in the direction of said longitudinal axis enabling detection of charged particles in a wide energy range with first order focussing and a voltage providing said substantially constant potential distribution enabling detection of charged particles in said narrower energy range with second order focussing.

19. A charged particle energy analyser for simultaneous detection of charged particles within a range of energies, the analyser comprising position sensitive detector which has optically transparent electrically non-conductive plate on top of the position sensitive detector component where said optically transparent plate is at least on one side covered in optically transparent electro-conductive material and the potential of the said optically conductive material is kept close to the detector common potential.

20. A charged particle energy analyser for simultaneous detection of charged particles within a range of energies as claimed in claim 19 wherein said position sensitive detector comprises:

a semiconductor detector member coupled to a single fiber optic plate (FOP) and micro channel plate (MCP), where the said FOP opposing sides are covered with conductive optically transparent layers, and the layer adjacent to the semiconductor detector sensitive elements is kept at ground voltage or a voltage close to average voltage of the said semiconductor detector sensitive elements while the second layer, adjacent to said MCP, is covered in phosphor and kept at a high positive voltage of several kV with respect to the said MCP.

* * * * *